United States Patent [19]

Smith

[11] 4,259,616

[45] Mar. 31, 1981

[54] MULTIPLE GASEOUS LAMP ELECTRONIC BALLAST CIRCUIT

[75] Inventor: Gerald T. Smith, Muncy, Pa.

[73] Assignee: GTE Products Corporation, Stamford, Conn.

[21] Appl. No.: 55,676

[22] Filed: Jul. 9, 1979

[51] Int. Cl.[3] ..... H05B 41/16; H05B 41/24

[52] U.S. Cl. ..... 315/256; 315/185 R; 315/255; 315/257; 315/278; 315/DIG. 5; 315/DIG. 7; 331/113 A

[58] Field of Search ..... 315/DIG. 7, DIG. 5, 315/DIG. 4, 185, 256, 220, 278, 277, 209, 255, 256, 257, 209 R; 331/113 A

[56] References Cited

U.S. PATENT DOCUMENTS

| | | | |
|---|---|---|---|
| 2,020,786 | 11/1935 | Klinkhamer et al. | 315/256 X |
| 2,030,434 | 2/1936 | Dorgelo | 315/256 |
| 2,683,241 | 7/1954 | Passmore | 315/256 X |
| 3,159,766 | 12/1964 | Harpley | 315/255 X |
| 3,754,160 | 8/1973 | Jensen | 315/DIG. 5 |
| 4,075,476 | 2/1978 | Pitel | 315/DIG. 5 |
| 4,127,795 | 11/1978 | Knoll | 315/DIG. 7 |
| 4,127,893 | 11/1978 | Goepel | 331/113 A |

*Primary Examiner*—Saxfield Chatmon, Jr.
*Attorney, Agent, or Firm*—Thomas H. Buffton

[57] ABSTRACT

An electronic ballast circuit for a multiple gaseous lamp load includes a feedback rectifier circuit coupled to a high frequency inverter circuit and to a DC source. The high frequency inverter circuit is also coupled to the multiple gaseous load and a variation in an alterable impedance of the feedback rectifier circuit causes a variation in power applied to the multiple gaseous load and power provided by the DC source.

6 Claims, 1 Drawing Figure

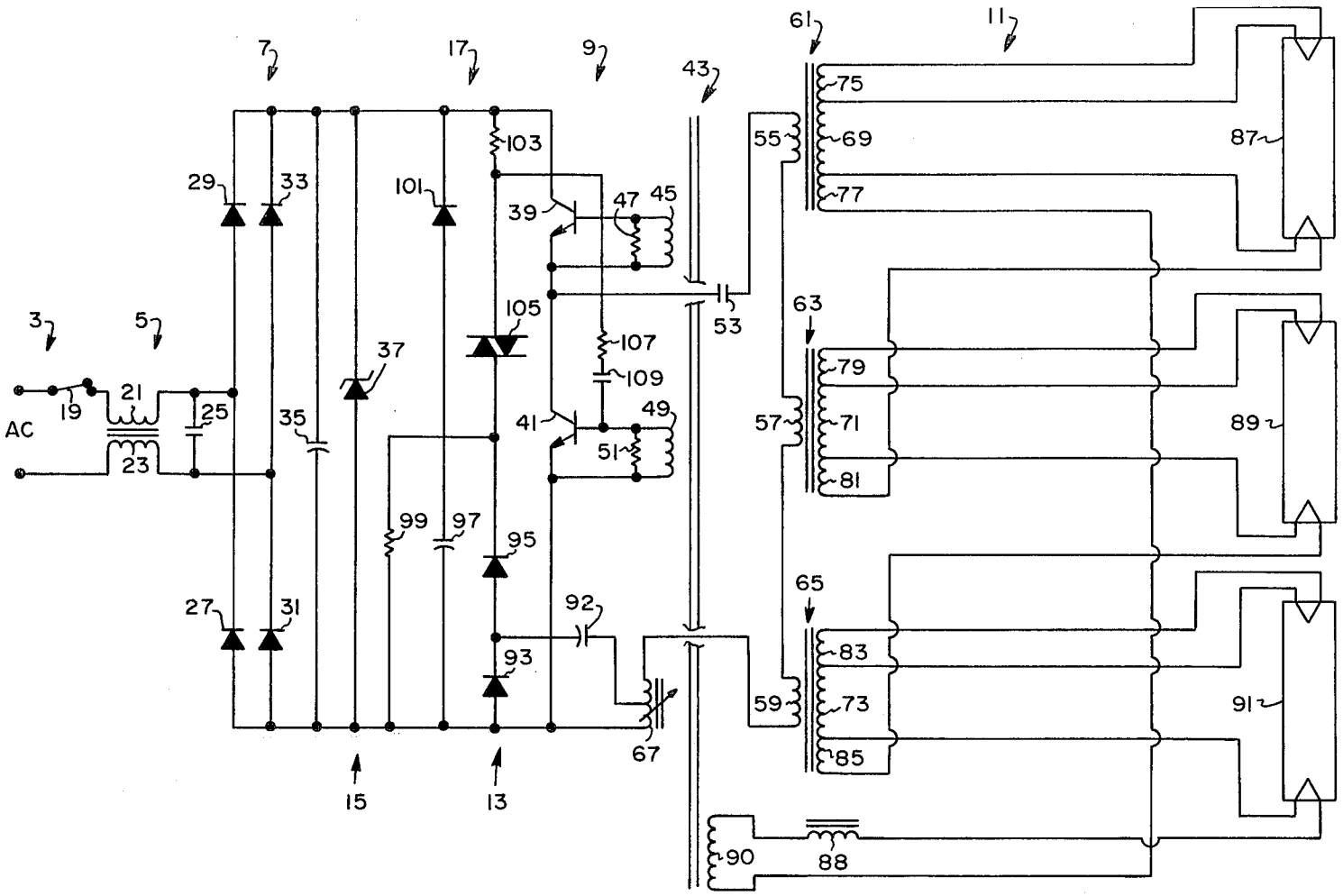
AC
3
5
7
9
11
13
15
17
19
21
23
25
27
29
31
33
35
37
39
41
43
45
47
49
51
53
55
57
59
61
63
65
67
69
71
73
75
77
79
81
83
85
87
88
89
90
91
92
93
95
97
99
101
103
105
107
109

MULTIPLE GASEOUS LAMP ELECTRONIC BALLAST CIRCUIT

CROSS REFERENCE TO OTHER APPLICATIONS

A pending application entitled "Direct Drive Ballast With Starting Circuit" filed Feb. 23, 1979 bearing U.S. Ser. No. 015,530 and assigned to the Assignee of the present application is directed to an oscillator starting circuit for an electronic ballast. A concurrently filed application by the inventor of the present application assigned to the same assignee bearing Ser. No. 055,677, non abandoned and entitled "Electronic Ballast Dimming Circuitry" is directed to an adjustable impedance form of "dimming" control circuitry.

TECHNICAL FIELD

This invention relates to electronic ballast circuitry for gaseous lamps and more particularly to a directly driven electronic ballast circuit especially suitable to a multiple gaseous lamp load such as a three lamp system.

BACKGROUND ART

Gaseous or fluorescent lamp systems normally employ a ballast system to compensate for abrupt impedance changes provided by the lamps when switched from one state of conductivity to another. Also, it has been known for some time that auto-transformer type ballast apparatus is relatively heavy, cumbersome, expensive and energy inefficient as compared with electronic ballast circuitry. Moreover, auto-transformer type ballast apparatus operates in the audible frequency range which is undesirable due to accompanying noises and disturbances annoying to the consumer.

Contrastingly, electronic ballast circuitry normally operates at relatively high frequencies, such as 20 to 30 KHz for example, which is well above the audible range and relatively free from undesired noise annoying to a consumer. Also, apparatus operating at such relatively high frequencies may be constructed smaller, less cumbersome and energy efficient as compared with auto-transformer apparatus.

Further, presently employed structures normally include a gaseous lamp fixture with either a two-lamp configuration and a single ballast circuit or a four-lamp configuration and a pair of ballast circuits. However, it is not uncommon for a two-lamp system to provide insufficient light and a four-lamp system to provide excessive light at a work surface. Thus, a three-lamp configuration is desirable but undesirably requires a pair of ballast circuits when commonly employed auto-transformers are utilized. Obviously, such apparatus is expensive with less than desirable energy efficiency.

SUMMARY OF THE INVENTION

In one aspect of the invention, a high frequency inverter circuit of an electronic ballast couples a potential source to a multiple gaseous lamp load circuit with an individual transformer for each lamp of the load circuit and the primary windings of all of the transformers series connected in a series resonant circuit of the high frequency inverter.

BRIEF DESCRIPTION OF THE DRAWINGS

The sole FIGURE is a schematic illustration of a preferred embodiment of an electronic ballast circuit for a multiple gaseous lamp load.

BEST MODE FOR CARRYING OUT THE INVENTION

For a better understanding of the invention, together with other and further objects, advantages and capabilities thereof, reference is made to the following disclosure and appended claims in conjunction with the accompanying drawing.

Referring to the drawing, an electronic ballast circuit for a multiple gaseous lamp load includes an AC source 3 coupled by a line conditioning circuit 5 to a full-wave DC rectifier 7. The full-wave DC rectifier 7 is coupled to a high frequency inverter circuit 9 which is, in turn, coupled to a multiple gaseous lamp load circuit 11 and to a feedback rectifier circuit 13. The feedback rectifier circuit 13 is connected to a charge storage and isolating circuit 15 shunting the full-wave DC rectifier 7. Also, an oscillator starting circuit 17 is connected to the full-wave DC rectifier circuit, the feedback rectifier circuit 13, the charge storage and isolating circuit 15, and AC coupled to the high frequency inverter circuit 9.

In greater detail, the line conditioner circuit 5 includes an overload switch 19 connected to one terminal of the AC source 3 and to a first inductive winding 21. A second inductive winding 23, preferably affixed to the same core as the first inductive winding 21 to provide enhanced mutual coupling, is connected to the other terminal of the AC source 3. A capacitor 25 is shunted across the first and second inductive windings 21 and 23 respectively.

The full-wave DC rectifier 7 includes a first pair of series connected diodes 27 and 29 having a junction therebetween connected to one side of the line conditioning circuit 5. A second pair of series connected diodes 31 and 33 has a junction therebetween connected to the other side of the line conditioning circuit 5. Also, a filter capacitor 35 and a zener diode 37 are each shunted across the series connected first and second pairs of diodes 27 and 29 and 31 and 33 respectively.

Connected across the full-wave DC rectifier 7 is the high frequency inverter circuit 9 including a pair of substantially identical series connected transistors 39 and 41. A first transformer 43 has a first secondary winding 45 shunted by a damping resistor 47 and coupled to the base and emitter electrodes of one transistor 39 of the pair of transistors 39 and 41 and a second secondary winding 49 shunted by a damping resistor 51 and coupled to the other transistor 41 of the pair of transistors 39 and 41 of the high frequency inverter circuit 9.

The junction of the series connected transistors 30 and 41 is connected to a capacitor 53 in series connection with the primary windings 55, 57 and 59 respectively of second, third and fourth transformers 61, 63 and 65 respectively and an alterable impedance 67 of the feedback rectifier circuit 13. The capacitor 53; first, second and third primary windings 55, 57 and 59; and alterable impedance 67 provide a circuit series resonant at a frequency in the range of about 20 to 30 KHz and include a "dimming" feature which will be explained hereinafter.

Each of the second, third and fourth transformer 61, 63 and 65 also includes a secondary winding, 69, 71 and 73 respectively and a first and second filament winding 75 and 77; 79 and 81; and 83 and 85. A gaseous lamp 87, 89 and 91 is coupled to each of the second, third and fourth transformer 61, 63 and 65. Also, the second filament windings 77, 81 and 85 of each of the transformers 61, 63 and 65 are series connected via an inductor 88 to a primary winding 90 of the first transformer 43 to provide drive potentials for the high frequency inverter circuit 9.

The feedback rectifier circuit 13 includes the alterable impedance 67 in series connection with and part of the resonant circuit of the high frequency inverter circuit 9 and coupled by a capacitor 92 to the junction of a pair of series connected diodes 93 and 95 forming a voltage doubler circuit. Also, the diode 95 of the feedback rectifier circuit 13 is connected to the charge storage and isolating circuit 15 at the junction of a series connected capacitor 97 shunted by a resistor 99 and a diode 101 shunted across the full wave DC rectifier 7.

Additionally, an oscillator starting circuit 17 includes a resistor 103 connected to a diac 105 which is directly coupled to the feedback rectifier circuit 13 and to the junction of the charge storage and isolating circuit 15. The junction of the series connected resistor 103 and diac 105 is AC coupled via a series connected impedance 107 and capacitor 109 to the transistor 41 of the high frequency inverter circuit 9.

As to operation, the AC source 3 provides a potential to the line conditioner circuit 5 which serves as a filter for radio frequency inteference (RFI) signals as well as for undesired transient pulse signals. Such undesired signals are filtered by the first and second inductors 21 and 23 and in conjunction with the filter capacitor 25 provide an RFI filter capability whereby a relatively "clean" AC potential is applied to the full-wave DC rectifier 7.

The full-wave DC rectifier 7 responds to the applied AC potential to provide a pulsating DC potential having a frequency of about 120 Hz. This pulsating DC potential is altered by the charge storage and isolating circuit 15, in a manner to be explained hereinafter, to provide a relatively steady-state DC potential which is applied to the high frequency inverter circuit 9.

The high frequency inverter circuit 9 is in the form of a chopper or oscillator circuit wherein the series connected transistors 39 and 41 operate in a push-pull mode. The chopper or oscillator has an output circuit which is series resonant at a frequency in the range of about 20 to 30 KHz and well above the audible range whereat undesired signal noise would be annoying to a consumer. This series resonant output circuit includes the capacitor 53; the primary windings 55, 57 and 59 of all of the second, third and fourth transformers 61, 63 and 65; and the alterable impedance 67 of the feedback rectifier circuit 13.

Since the circuitry is of the high frequency type, it has been found advantageous to utilize a relatively small individual transformer for each lamp of the multiple gaseous lamp load circuit 11. Also, connecting the primary windings 55, 57 and 59 in series provides a relatively high starting voltage for the multiple gaseous lamp load circuit 11. Upon firing one of the lamps, the available potential is re-distributed between the remaining un-fired lamps which provides an immediate increased potential and energization of another one of the lamps. Moreover, the sequence is repeated until all of the lamps have been energized.

Importantly, the individual transformers, which could conceivably be in the form of multiple windings on a single core, permit a series connection of the primary windings 55, 57 and 59 while the lamps 87, 89 and 91 are parallel connected. Thus, a relatively high potential is provided to initiate energization of the lamps and this potential is reduced once the lamps have been ignited. Thus, undesired high potentials do not appear at the lamp contacts once the lamp has been rendered operational.

Further, the second filament windings 77, 81 and 85 of all of the second, third and fourth transformers 61, 63 and 65 are series connected to the primary winding 89 of the first transformer 43. Thus, removal of any one of the lamps 87, 89 and 91 causes interruption of the potential provided at the primary winding 89 and applied to the secondary windings 45 and 49 of the first transformer 43 for maintaining operation of the high frequency inverter circuit 9. As a result, the high frequency inverter circuit 9 is rendered inoperative whenever a lamp fails or is removed whereupon all of the lamps 87, 89 and 91 are rendered inoperative.

As to the "dimming" control capabilities, the alterable impedance in the form of an adjustable inductor 67 of the feedback rectifier circuit 13 is essentially in series connection with the impedance of the gaseous lamp circuitry. As to the value of the adjustable inductor 67 is increased, the relative impedance is correspondingly decreased. Thus, the percent of input power "pumped back" to the charge storage and isolating circuit 15 is increased while the percentage of input power to the lamp load is decreased and "dimming" of the lamps results.

Referring for a moment to the charge storage and isolating circuit 15, energy provided by the feedback rectifier circuit 13 is stored in the charge capacitor 97 and applied via the diode 101 to the DC rectifier 7 whenever the pulsating DC potential decreases below a given reference level. In this manner, a relatively steady-state DC potential is applied to the high frequency inverter circuit 9.

However, increasing the power "pumped back" by the feedback rectifier circuit 13 while reducing the power utilized by the lamp load provides an increased amount of energy available to the high frequency inverter circuit 9. As a result, the energy demand from the power source 3 is reduced and a saving in power requirements is achieved. Moreover, it has been found that circuit efficiency remains practically constant for light output variations in the range of about 60 to 120%

.

Finally, it is known that the switching capability of the transistors 39 and 41 of the high frequency inverter circuit 9 is enhanced when driven directly from a transformer rather than by way of a complex base biasing arrangement. However, it is also known that a directly driven high frequency inverter circuit 9 will not self-start. Thus, starting circuitry is necessary.

Herein, there is no energy fed back to the charge storage capacitor 97 of the charge storage and isolating circuit 15 until the high frequency inverter circuit 9 is operational. However, energy is provided by the AC source 3 in an amount sufficient to develop a charge on the capacitors 35 and 109 of the oscillator starting circuit 17 via the resistor 103, impedance 107 and winding 49 of the first transformer 43.

When the charge on the capacitor 109 exceeds the breakover voltage of the diac 105, the capacitor 109 discharges through the impedance 107, diac 105, capacitor 97, and the winding 57 of the first transformer 43. The transformer winding 57 transmits this potential discharge to the transistor 41 to bias the transistor 41 on and start the oscillator of the high frequency inverter circuit 9. Thereupon, the high frequency inverter circuit 9 develops a potential and charges the storage capacitor 97 via the feedback rectifier circuit 13. Thus, the capacitor 97 is charged in an amount sufficient to prevent the voltage across the isolating diode 101 from reaching a value sufficient to effect breakover of the diac 105 and the oscillator starting circuit 17 is in effect, removed from the operational circuitry.

While there has been shown and described what is at present considered the preferred embodiment of the invention, it will be obvious to those skilled in the art that various changes and modifications may be made therein without departing from the invention as defined by the appended claims.

INDUSTRIAL APPLICABILITY

Thus, there has been provided an enhanced electronic ballast circuit for a multiple gaseous lamp load circuit wherein utilization of a high frequency inverter circuit permits use of individual transformers for each lamp of the load circuit. The primary windings of the transformers are series connected to provide relatively high initial voltages for each lamp and relatively low maintaining potentials at the contacts of each lamp during operation. Also, a filament winding of each transformer is series connected and provides a maintaining voltage for the high frequency inverter. However, removal of a lamp disconnects the maintaining voltage which stops the high frequency inverter and inactivates all of the lamps of the multiple gaseous lamp load circuit.

I claim:

1. A multiple gaseous lamp electronic ballast circuit having a high frequency inverter circuit coupled to a potential source and a multiple gaseous lamp load circuit and characterized by a separate transformer having a primary, secondary and a pair of filament windings, said primary windings of all of said separate transformers series coupled to said high frequency inverter circuit, said secondary windings and said pair of filament windings of each transformer coupled to one of said gaseous lamps, and one of said pair of filament windings of each of said transformers series connected to said high frequency inverter circuit.

2. The multiple gaseous lamp electronic ballast circuit of claim 1 wherein said multiple gaseous lamp load circuit includes three lamps with said primary windings for each of said three lamps series connected to said high frequency inverter circuit.

3. The multiple gaseous lamp electronic ballast circuit of claim 1 wherein said primary windings of all of said lamps series connected to said high frequency inverter circuit are included in a circuit series resonant at a frequency in the range of about 20 to 30 KHz.

4. The multiple gaseous lamp electronic ballast circuit of claim 1 including three lamps in said multiple gaseous lamp load circuit, a transformer for each one of said three lamps, each of said transformers having a primary, secondary and a pair of filament windings with said primary windings of all of said transformers series connected to said high frequency inverter circuit, said secondary windings and said pair of filament windings of each of said transformers coupled to one of said three lamps, and one of said pair of filament windings of each of said transformers in series connection with a filament winding of each of said other transformers and said high frequency inverter circuit.

5. A multiple gaseous lamp electronic ballast circuit having a full-wave DC rectifier coupled to an AC source, shunted by a charge storage and isolating network, and coupled to a high frequency inverter circuit with a feedback rectifier circuit coupled to the charge storage and isolating network and a multiple gaseous lamp load circuit, said ballast circuit characterized by the improvement comprising a transformer having a primary, a secondary and a pair of filament windings for each gaseous lamp series connected to said high frequency inverter circuit and said feedback rectifier circuit and one of said pair of filament windings of each of said gaseous lamps series connected to said high frequency inverter circuit.

6. The improvement of claim 5 wherein said multiple gaseous lamp load circuit includes three lamps with a transformer coupled to each lamp and all of said transformers series connected to said high frequency inverter and feedback rectifier circuits.

* * * * *